US009981474B2

(12) United States Patent
Goto

(10) Patent No.: US 9,981,474 B2
(45) Date of Patent: May 29, 2018

(54) LIQUID EJECTING APPARATUS

(71) Applicant: SEIKO EPSON CORPORATION, Tokyo (JP)

(72) Inventor: Junichi Goto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/428,015

(22) Filed: Feb. 8, 2017

(65) Prior Publication Data

US 2017/0225470 A1 Aug. 10, 2017

(30) Foreign Application Priority Data

Feb. 10, 2016 (JP) ..... 2016-023392

(51) Int. Cl.

| | |
|---|---|
| ***B41J 2/165*** | (2006.01) |
| ***B41J 2/17*** | (2006.01) |
| ***B41J 3/407*** | (2006.01) |
| ***B41J 11/00*** | (2006.01) |

(52) U.S. Cl.

CPC ..... *B41J 2/16517* (2013.01); *B41J 2/165* (2013.01); *B41J 2/1714* (2013.01); *B41J 3/4078* (2013.01); *B41J 11/002* (2013.01); *B41J 11/007* (2013.01)

(58) Field of Classification Search

CPC ..... B41J 2/16517; B41J 2/165; B41J 2/1714
See application file for complete search history.

(56) References Cited

U.S. PATENT DOCUMENTS

| | | | | |
|---|---|---|---|---|
| 5,774,141 | A | 6/1998 | Cooper et al. | |
| 6,030,076 | A | 2/2000 | Yoshimura et al. | |
| 2008/0253797 | A1 | 10/2008 | Sakagami | |
| 2009/0278883 | A1 | 11/2009 | Rawlings et al. | |
| 2012/0007916 | A1* | 1/2012 | Kumagai | B41J 2/1714 347/34 |
| 2012/0062679 | A1* | 3/2012 | Yokota | B41J 11/0015 347/104 |
| 2015/0085014 | A1* | 3/2015 | Ishida | B41J 2/1714 347/34 |
| 2015/0124034 | A1* | 5/2015 | Shinoda | B41J 3/4078 347/104 |

FOREIGN PATENT DOCUMENTS

| | | |
|---|---|---|
| EP | 2123465 | 11/2009 |
| EP | 2857209 | 4/2015 |
| JP | 10-168765 | 6/1998 |
| JP | 2004256299 | 9/2004 |
| JP | 2011-179131 | 9/2011 |
| JP | 2015-067931 | 4/2015 |

OTHER PUBLICATIONS

European Search Report issued in Application No. 17155119 dated Jul. 6, 2017.

* cited by examiner

*Primary Examiner* — Jason Uhlenhake

(74) *Attorney, Agent, or Firm* — Workman Nydegger

(57) ABSTRACT

A liquid ejecting apparatus includes a transport unit that transports a medium, an ejecting unit that ejects a liquid onto the medium in an ejection area, a mist-collecting unit that collects mist that occurs with the ejection of the liquid from the ejecting unit, and a contaminant-collecting unit that is formed upstream of the ejection area in a transport direction of the medium and that collects contaminants that have attached to the medium.

14 Claims, 9 Drawing Sheets

LIQUID EJECTING APPARATUS

BACKGROUND

1. Technical Field

The present invention relates to a liquid ejecting apparatus.

2. Related Art

To date, various liquid ejecting apparatuses such as ink jet recording devices have been used. Among such liquid ejecting apparatuses, for example, in liquid ejecting apparatuses that are capable of using cloth as a medium (target recording medium), contaminants such as fluff might attach to the medium, and in the case where these contaminants come in contact with a liquid ejecting unit, damage might occur when forming an image and image quality might decrease.

Therefore, for example, a liquid ejecting apparatus (printer for textile printing) that suppresses a decrease in image quality by adsorbing fluff onto cloth, which serves as a medium, disclosed in JP-A-10-168765 has been developed.

Here, in a liquid ejecting apparatus, mist occurs with the ejection of liquid from an ejecting unit, and as a result of this mist coming in contact with contaminants such as fluff the image quality might decrease. However, because the liquid ejecting apparatus disclosed in JP-A-10-168765 simply causes fluff to be adsorbed on the cloth, which serves as a medium, and is not capable of suppressing mist from coming into contact with contaminants such as fluff, the liquid ejecting apparatus is not capable of suppressing a decrease in image quality as a result of mist coming into contact with contaminants such as fluff.

SUMMARY

An advantage of some aspects of the invention is that a decrease in image quality due to the attachment of mist on contaminants that have attached to a medium is suppressed.

A liquid ejecting apparatus according to an aspect of the invention includes a transport unit that transports a medium, an ejecting unit that ejects a liquid onto the medium in an ejection area, a mist-collecting unit that collects mist that occurs with the ejection of the liquid from the ejecting unit, and a contaminant-collecting unit that is formed upstream of the ejection area in a transport direction of the medium and that collects contaminants that have attached to the medium.

In this case, the liquid ejecting apparatus includes a mist-collecting unit that collects mist that occurs with the ejection of ink from the ejecting unit and a contaminant-collecting unit that is formed upstream of the ejection area in a transport direction of the medium and that collects contaminants that have attached to the medium. Consequently, it is possible to effectively suppress a decrease in image quality caused by the mist attaching to contaminants that have attached to the recording medium by collecting both the mist and the contaminants.

In the liquid ejecting apparatus according to the aspect of the invention, at least one of the mist-collecting unit and the contaminant-collecting unit may have a collection opening that extends over an entirety in a width direction of the transport unit that intersects the transport direction.

In this case, at least one of the mist-collecting unit and the contaminant-collecting unit may have a collection opening that extends over an entirety in a width direction of the transport unit that intersects the transport direction. Consequently, over an entirety in the width direction of the transport unit, it is possible to effectively suppress a decrease in image quality caused by mist attaching to contaminants that have attached to the recording medium.

The liquid ejecting apparatus according to the aspect of the invention may include a carriage that includes the ejecting unit and that reciprocates in a width direction of the transport unit that intersects the transport direction and at least one of the mist-collecting unit and the contaminant-collecting unit has a collection opening formed in the carriage.

In this case, at least one of the mist-collecting unit and the contaminant-collecting unit may have a collection opening formed in the carriage. Consequently, in the liquid ejecting apparatus including a carriage that includes the ejecting unit and that reciprocates in a width direction of the transport unit, by forming the collection opening in the carriage, it is possible to easily form the collection opening, and it is possible to suppress, at a low cost, a decrease in image quality due to the attachment of mist on the contaminants that have attached to the recording medium.

In the liquid ejecting apparatus according to the aspect of the invention, a collection opening of the mist-collecting unit may face in a direction different to the direction of gravity.

In this case, a collection opening of the mist-collecting unit may face in a direction different to the direction of gravity. Consequently, it is possible to, even in the case where mist collected from the collection opening is accumulated, suppress dirtying of the recording medium, the recording device, and the like due to dripping of the accumulated mist.

The liquid ejecting apparatus according to the aspect of the invention may include a carriage that includes the ejecting unit and that reciprocates in a width direction of the transport unit that intersects the transport direction, and a blowing unit that blows air toward the collection opening of the mist-collecting unit may be formed in the carriage.

In this case, a blowing unit that blows air toward the collection opening of the mist-collecting unit may be formed in the carriage. Consequently, in the liquid ejecting apparatus including a carriage that includes the ejecting unit and that reciprocates in the width direction of the transport unit, by forming the blowing unit in the carriage, it is possible to easily form the blowing unit, and it is possible to suppress a decrease in image quality due to the attachment of mist on contaminants that have attached to the recording medium.

In the liquid ejecting apparatus according to the aspect of the invention, the blowing unit may be formed at each end of the ejecting unit in the width direction of the transport unit, and, among the blowing units at the ends of the ejecting unit, the downstream side blowing unit located downstream with respect to the direction of reciprocation of the carriage blows out air.

In this case, the blowing unit may be formed at each end of the ejecting unit in the width direction of the transport unit, and among the blowing units at the ends of the ejecting unit, the downstream side blowing unit located downstream with respect to the direction of reciprocation of the carriage blows out air. Among the blowing units, because the downstream side blowing unit located downstream with respect to the direction of reciprocation of the carriage is capable of blowing air toward the mist immediately after the mist has been generated from the recording head, the effect of moving the mist by the downstream side blowing unit is larger than that by the upstream side blowing unit located on the upstream side. Consequently, by causing only the upstream side blowing unit to be driven, it is possible to effectively suppress a decrease in image quality caused by the mist attaching to the contaminants that have attached to the medium and it is possible to reduce power consumption as a result of not causing the upstream side blowing unit to be driven. Note that the meaning of "upstream" and "downstream" in the width direction of the transport unit is different from that of "upstream" and "downstream" in the transport direction of the medium.

The liquid ejecting apparatus according to the aspect of the invention may include a sticky member on which an adhesive agent is attached.

In this case, the contaminant-collecting unit may include a sticky member on which an adhesive agent is attached. Consequently, it is possible to reliably collect the contaminants by using the sticky member.

The liquid ejecting apparatus according to the aspect of the invention may include a destaticizing unit that destaticizes the medium.

In this case, the contaminant-collecting unit may include a destaticizing unit that destaticizes the medium. Consequently, it is possible to suppress sticking of the recording medium and the contaminants by destaticization and it is possible to effectively collect the contaminants.

In the liquid ejecting apparatus according to the aspect of the invention, the contaminant-collecting unit may include a compressed air unit that blows compressed air onto the medium.

In this case, the contaminant-collecting unit may include a compressed air unit that blows compressed air onto the medium. Consequently, it is possible to effectively remove contaminants from the medium by using the compressed air unit and it is possible to effectively collect the contaminants.

In the liquid ejecting apparatus according to the aspect of the invention, the contaminant-collecting unit may include a vibration generator that vibrates the medium.

In this case, the contaminant-collecting unit may include a vibration generator that vibrates the medium. Consequently, it is possible to effectively remove contaminants from the medium by using the vibration generator and it is possible to effectively collect the contaminants.

In the liquid ejecting apparatus according to the aspect of the invention, the contaminant-collecting unit may include a heating unit that heats the medium.

In this case, the contaminant-collecting unit may include a heating unit that heats the medium. Because it is possible to weaken the adhesion power of the contaminants with respect to the medium by heating the medium, it is possible to effectively remove contaminants from the medium and it is possible to effectively collect the contaminants.

The liquid ejecting apparatus according to the aspect of the invention may have the mist-collecting unit formed upstream of the ejection area in the transport direction of the medium.

In this case, the mist-collecting unit may be formed upstream of the ejection area in the transport direction of the medium. That is, it is possible to arrange the mist-collecting unit near the contaminant-collecting unit. Consequently, it is possible for the mist-collecting unit and the contaminant-collecting unit to have a common part.

The liquid ejecting apparatus according to the aspect of the invention may have the mist-collecting unit formed downstream of the ejection area in the transport direction of the medium.

In this case, the mist-collecting unit may be formed downstream of the ejection area in the transport direction of the medium. Consequently, it is possible to suppress movement of the mist toward the side upstream of the ejecting unit and it is possible to suppress dirtying of the recording medium by mist before ejection of liquid onto the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording device serving as a liquid ejecting apparatus according to an embodiment of the invention will be described with reference to the accompanying drawings.

First Embodiment, FIGS. 1 to 4

First, a recording device 1 according to a first embodiment of the invention will be described briefly.

Figure 1:
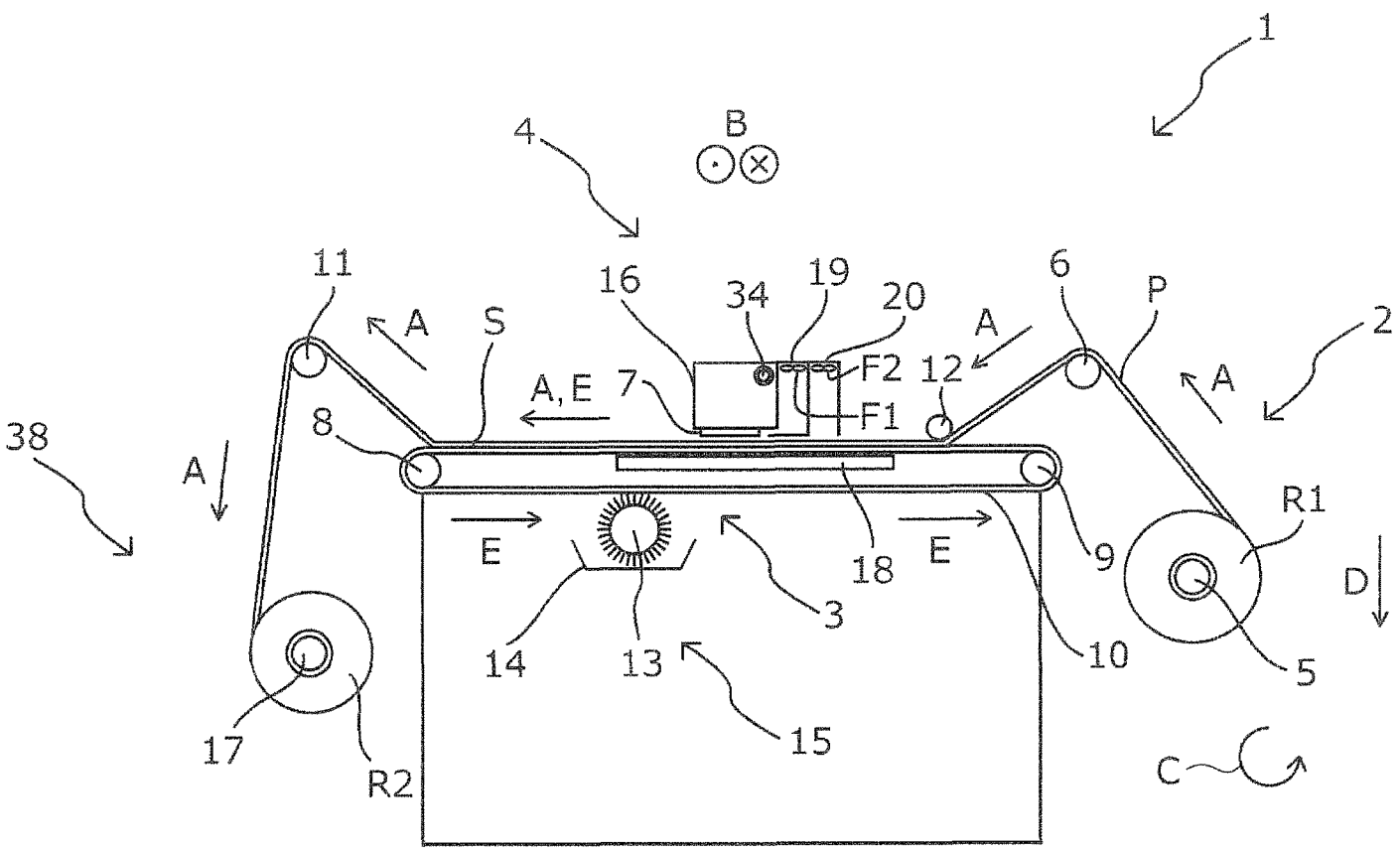
FIG. 1 is a schematic side view of a recording device according to a first embodiment of the invention.

FIG. 1 is a schematic side view of the recording device 1 of this embodiment. Further, in FIG. 1, in order to make overall configuration easy to understand, illustration is given with some of the constituent members (a housing unit 37, blowing units 35 and 36, and the like described later) omitted.

The recording device 1 of this embodiment includes a feeding section 2 that is capable of reeling out a roll R1 of a recording medium P (medium) to be recorded on. Moreover, the recording device 1 of this embodiment includes a transport mechanism 3 that transports the recording medium P in a transport direction A by a sticky belt 10 (a transport belt formed of an endless belt) that supports the recording medium P on a supporting surface S on which an adhesive agent has been attached. Moreover, the recording device 1 of this embodiment includes a recording mechanism 4 that records on the recording medium P by reciprocally scanning a carriage 16 in a reciprocation direction B that intersects the transport direction A of the recording medium P, the carriage 16 including a recording head 7 that serves as an ejecting unit that ejects ink which is an example of a liquid. Moreover, the recording device 1 of this embodiment includes a washing mechanism 15 for the sticky belt 10. Furthermore, the recording device 1 of this embodiment includes a winding mechanism 38 that has a winding shaft 17 that winds up the recording medium P.

The feeding section 2 includes a rotation shaft 5 that serves as a setting position for the roll R1 of the recording medium P to be recorded on, and is capable of reeling out the recording medium P from the roll R1 set on the rotation shaft 5 to the transport mechanism 3 through a driven roller 6. Further, when reeling out the recording medium P to the transport mechanism 3, the rotation shaft 5 rotates in the rotation direction C.

The transport mechanism 3 includes the sticky belt 10 that carries and transports the recording medium P that has been reeled out from the feeding section 2, a drive roller 8 that moves the sticky belt 10 in a direction E, and a driven roller 9. The recording medium P, as a result of being pushed against the supporting surface S of the sticky belt 10 by a push roller 12, is stuck to and carried by the sticky belt 10. Further, when the recording medium P is being transported, the drive roller 8 rotates in a rotation direction C.

However, the transport mechanism 3 is not limited to a sticky endless belt serving as a transport belt. For example, an electrostatically attracting endless belt may be used.

Moreover, a platen 18 serving as a supporting unit capable of supporting the sticky belt 10 is provided on a lower portion of the sticky belt 10 of this embodiment. As a result of the platen 18 supporting the sticky belt 10, it is possible to suppress, for example, vibration of the sticky belt 10 while the sticky belt 10 is being moved.

Further, the push roller 12 of this embodiment is capable of reciprocating (swinging) in the transport direction A in order to suppress formation of a contact mark on the recording medium P as a result of the push roller 12 being in contact with the same area of the recording medium P for a fixed time. However, the push roller 12 is not limited to such a structure.

The recording mechanism 4 has a carriage motor 30 (refer to FIG. 4) that reciprocates the carriage 16 including the recording head 7 along a scanning shaft 34 in the reciprocation direction B. Further, the reciprocation direction B in FIG. 1 is a direction perpendicular to the paper surface and the ink ejection direction is in the gravity direction D. The ink ejection area is an area that faces the recording head 7 in a movement range in the reciprocation direction B of the carriage 16.

When recording, recording is performed by reciprocally scanning the carriage 16 including the recording head 7; however, during scanning (during movement of the carriage 16), the transport mechanism 3 stops transport of the recording medium P. In other words, when recording, the reciprocative scanning of the carriage 16 and the transporting of the recording medium P are alternated. That is, when recording, in accordance with the reciprocative scanning of the carriage 16, the transport mechanism 3 causes the recording medium P to be intermittently transported (intermittent movement of the sticky belt 10).

Further, the recording device 1 of this embodiment includes the recording head 7 that ejects ink while reciprocating in the reciprocation direction B; however, a recording device may include a so-called line head in which nozzles that eject ink are provided in a plurality in an intersecting direction that intersects the movement direction of the recording medium P.

Here, a "line head" is a recording head in which a nozzle region formed in an intersecting direction that intersects the movement direction of the target recording medium P is disposed in such a manner as to be capable of covering the whole or most of the target recording medium P in the intersecting direction, and is used in a recording device that forms an image by moving the recording head and the target recording medium P relative to each other. Further, the region of the nozzles in the intersecting direction of the line head need not cover all types of target recording media P that can be used in the recording device.

Moreover, although details will be given below, regarding the recording mechanism 4 of this embodiment, a mist-collecting unit 19 that collects, through suction power of a fan F1, mist that has been generated with the ejection of ink from the recording head 7 and a contaminant-collecting unit 20 that collects, through suction power of a fan F2, contaminants that have attached to the recording medium P are formed in the carriage 16.

Further, "contaminants" refers to, for example, fluff, dust or the like, that can affect the recording quality and that exists on a portion of the target recording medium P or on a surface (recording surface) on the side of the target recording medium P on which ink is to be ejected.

The washing mechanism 15 for the sticky belt 10 has a washing brush 13 formed of a plurality of washing rollers that are connected in the rotation shaft direction and a tray 14 that contains a washing agent for washing the washing brush 13.

The winding mechanism 38 is a mechanism that, after recording has been completed, winds the recording medium P that has been transported from the transport mechanism 3 via a driven roller 11 and the recording medium P can be wound as the roll R2 by setting a paper tube or the like for winding on the winding shaft 17 and winding the recording medium P therearound.

Next, the mist-collecting unit 19 and the contaminant-collecting unit 20, which are main parts of the recording device 1 of this embodiment, will be described.

Figure 2:
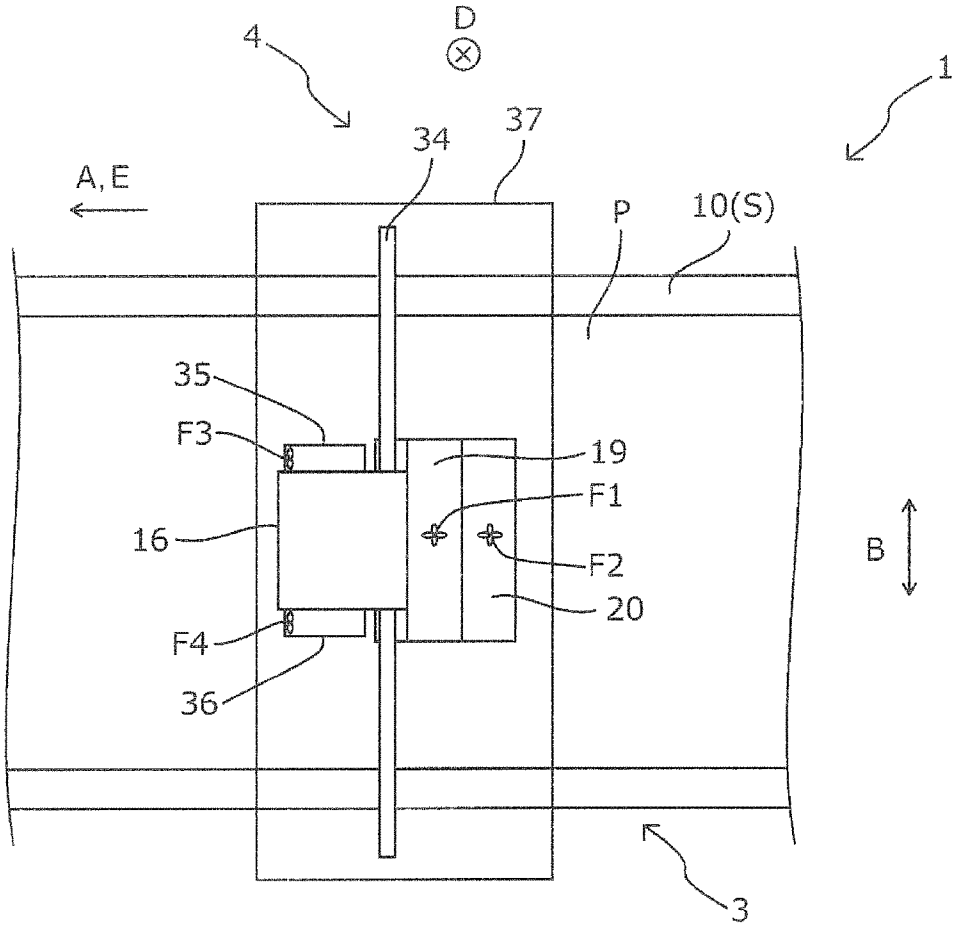
FIG. 2 is a schematic plan view of a main part of the recording device according to the first embodiment of the invention.

Here, FIG. 2 is a schematic plan view of the area around the mist-collecting unit 19 and the contaminant-collecting unit 20 of the recording device 1 of this embodiment. Moreover, FIG. 3 is a schematic side view of the area around the mist-collecting unit 19 and the contaminant-collecting unit 20 of the recording device 1 of this embodiment.

Figure 3:
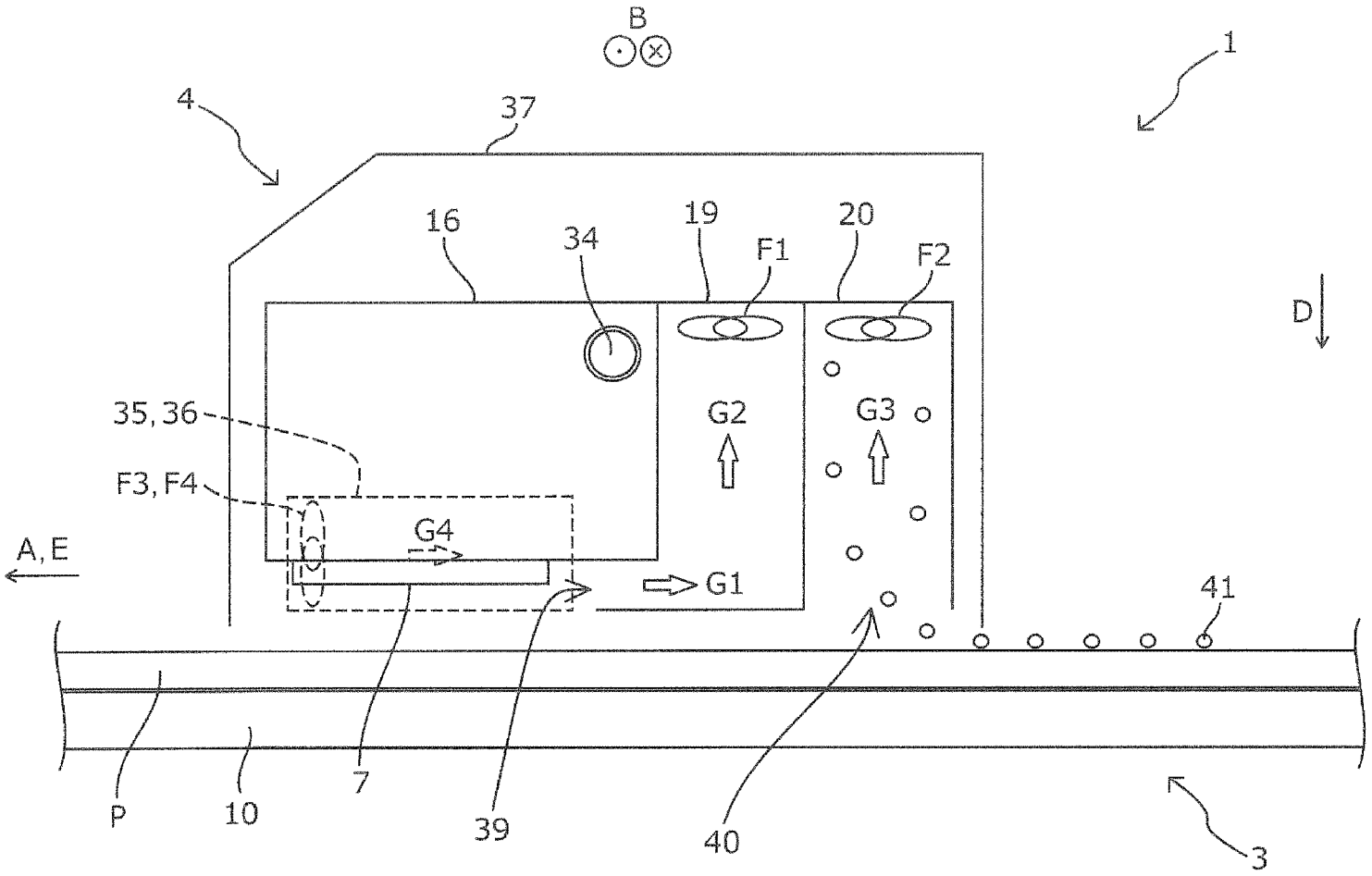
FIG. 3 is a schematic side view of the main part of the recording device according to the first embodiment of the invention.

As illustrated in FIGS. 2 and 3, in the recording device 1 of this embodiment, the carriage 16 that reciprocates in the reciprocation direction B along the scanning shaft 34 that extends in the reciprocation direction B is formed inside the housing unit 37. Moreover, in addition to the recording head 7, the mist-collecting unit 19, the contaminant-collecting unit 20, and the blowing units 35 and 36 are formed in the carriage 16.

In the mist-collecting unit 19, the fan F1 is provided, and it is possible to collect mist of the ink in directions G1 and G2 through the suction power of the fan F1 from a collection opening 39 that is formed on the side of the side surface (on the upstream side in the transport direction A) of the recording head 7 and that opens toward the downstream side in the transport direction A.

Moreover, on both sides of the recording head 7 in the reciprocation direction B of the carriage 16, blowing units (the blowing units 35 and 36) are formed at positions that include positions that face the collection opening 39. A fan F3 that generates an air flow in the direction G4 towards the collection opening 39 is formed in the blowing unit 35 and a fan F4 that generates an air flow in the direction G4 toward the collection opening 39 is formed in the blowing unit 36.

The mist-collecting unit 19 is capable of effectively collecting ink mist by the blowing of the blowing units 35 and 36.

In the contaminant-collecting unit 20, a fan F2 is provided, and it is possible to collect contaminants 41 such as fluff in the direction G3 through suction power of the fan F2 from a collection opening 40 that opens in the gravity direction D.

Further, ink mist collected by the mist-collecting unit 19 and the contaminants 41 collected by the contaminant-collecting unit 20 are adsorbed and stored by a replaceable adsorption mechanism (not illustrated). However, such a structure is not limited to the above-described structure and may be a structure including a discharge mechanism or the like that discharges ink mist collected by the mist-collecting unit 19 and the contaminants 41 collected by the contaminant-collecting unit 20 to the outside of the recording device 1.

Next, the electrical structure of the recording device 1 of this embodiment will be described.

Figure 4:
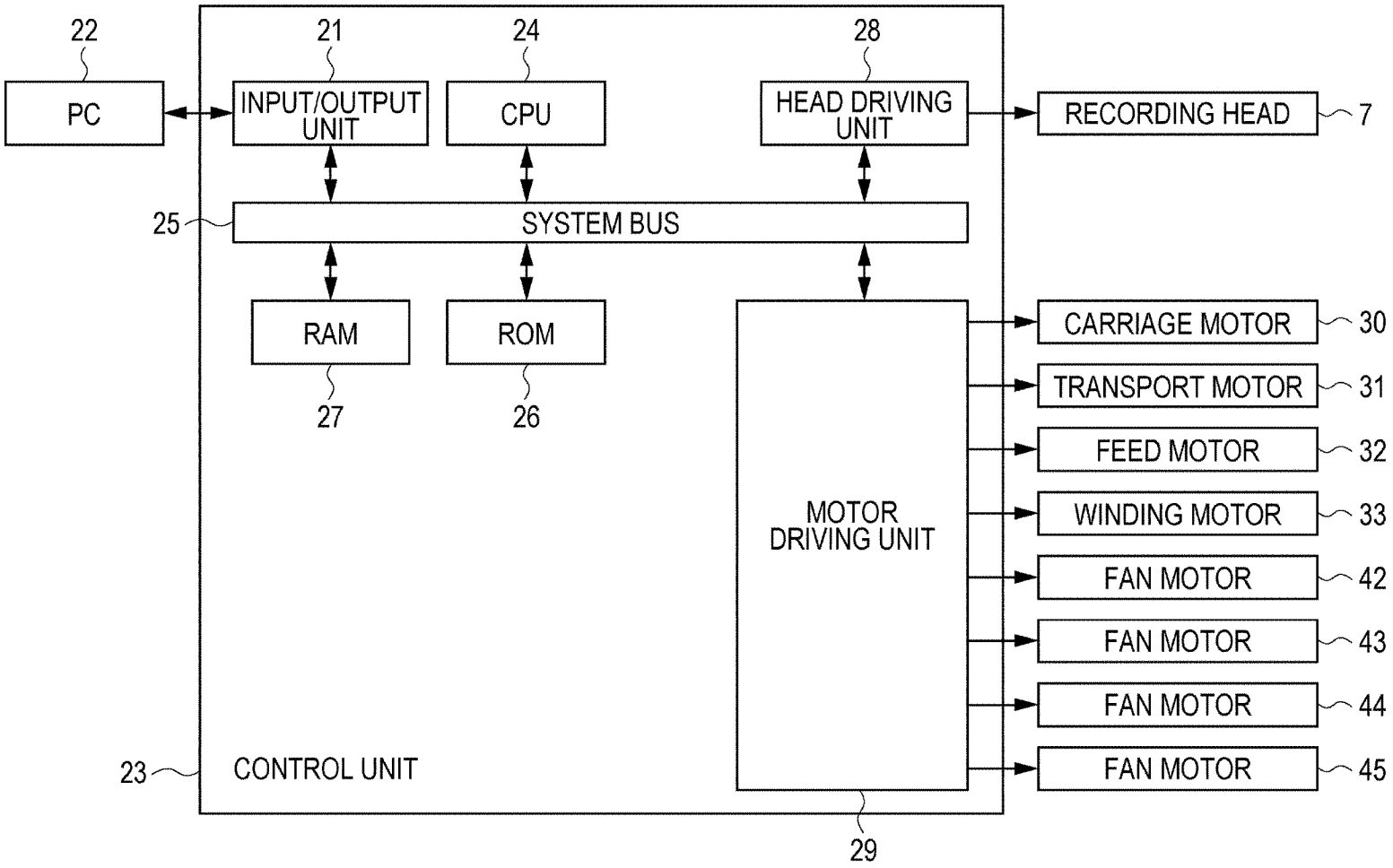
FIG. 4 is a block diagram illustrating the recording device according to the first embodiment of the invention.

FIG. 4 is a block diagram of the recording device 1 of this embodiment.

A CPU 24 that is capable of controlling the entirety of the recording device 1 is provided in a control unit 23. The CPU 24 is connected, through a system bus 25, to a ROM 26 that stores individual control programs and the like that the CPU 24 performs and a RAM 27 that is capable of temporarily storing data.

Moreover, the CPU 24 is connected, through the system bus 25, to a head driving unit 28 that drives the recording head 7.

Moreover, the CPU 24 is connected, through the system bus 25, to a motor driving unit 29 that drives the carriage motor 30, a transport motor 31, a feed motor 32, a winding motor 33, and fan motors 42, 43, 44, and 45.

Here, the carriage motor 30 is a motor that moves the carriage 16 that includes the recording head 7. Moreover, the transport motor 31 is a motor that drives the drive roller 8. Moreover, the feed motor 32 is a motor that drives the rotation shaft 5 in order to feed the recording medium P to the transport mechanism 3. Moreover, the winding motor 33 is a motor that causes the winding shaft 17 to rotate. In addition, the fan motor 42, the fan motor 43, the fan motor 44, and the fan motor 45 are motors for driving the fan F1, the fan F2, the fan F3, and the fan F4, respectively.

Moreover, the CPU 24 is connected, through the system bus 25, to an input/output unit 21, and the input/output unit 21 is connected to a PC 22 for performing transmission and reception of data, such as recording data, and signals.

The control unit 23 having the above-described configuration is capable of controlling the entirety of the recording device 1.

Here, to summarize the recording device 1 of this embodiment, the recording device 1 of this embodiment includes the sticky belt 10 that serves as a transport unit that transports the recording medium P, and the recording head 7 that ejects ink onto the recording medium P in an ejection region.

The recording device 1 of this embodiment includes the mist-collecting unit 19 that collects mist that occurs with the ejection of ink from the recording head 7 and the contaminant-collecting unit 20 that is formed upstream of the ejection area in the transport direction A of the recording medium P and that collects the contaminants 41 that have attached to the recording medium P. Consequently, the recording device 1 of this embodiment is formed so as to be capable of effectively suppressing a decrease in image quality caused by the mist attaching to the contaminants 41 that have attached to the recording medium P by collecting both the mist and the contaminants 41.

Moreover, the recording device 1 of this embodiment includes the carriage 16 that includes the recording head 7 and that reciprocates in the width direction (that is, the reciprocation direction B) of the sticky belt 10 which intersects the transport direction A, and the mist-collecting unit 19 and the contaminant-collecting unit 20 respectively have the collection openings 39 and 40 formed in the carriage 16.

In this way, as long as at least one of the collection openings of the mist-collecting unit 19 and the contaminant-collecting unit 20 is formed in the carriage 16, in the recording device 1 including the carriage 16 that includes the recording head 7 and that reciprocates in the width direction of the sticky belt 10 (reciprocation direction B), it is possible to easily form the at least one collection opening in the carriage and it is possible to suppress, at a low cost, a decrease in the image quality due to the attachment of mist on the contaminants 41 that have attached to the recording medium P.

Moreover, as illustrated in FIG. 3, the collection opening 39 of the mist-collecting unit 19 of the recording device 1 of this embodiment faces a direction different to the gravity direction D. Consequently, the recording device 1 of this embodiment, even in the case where mist collected from the collection opening 39 is accumulated, is capable of suppressing dirtying of the recording medium P, the recording device 1 and the like due to dripping of the accumulated mist.

Further, in the recording device 1 of this embodiment, the mist-collecting unit 19 and the contaminant-collecting unit 20 are formed independently (separated); however, the structure is not limited to this.

Moreover, as illustrated in FIGS. 2 and 3, the blowing units 35 and 36 that blow air toward the collection opening 39 of the mist-collecting unit 19 are formed in the carriage 16 of the recording device 1 of this embodiment. Consequently, in the recording device 1 including the carriage 16 that includes the recording head 7 and that reciprocates in the reciprocation direction B, it is possible to easily form a blowing unit in the carriage 16 and particularly effectively suppress a decrease in image quality due to the attachment of mist on the contaminants 41 that have attached to the recording medium P.

Here, in this embodiment, blowing units (the blowing units 35 and 36) are formed on both sides of the recording head 7 in the reciprocation direction B; however, the control unit 23 is capable of, among the blowing units, controlling the downstream side blowing unit located downstream with respect to the direction of reciprocation of the carriage 16 so as to blow air. For example, as illustrated in FIG. 2, in the case where the carriage 16 moves toward the blowing unit 35 side in the reciprocation direction B, the control unit 23 drives the blowing unit 36 and in the case where the carriage 16 moves toward the blowing unit 36 side in the reciprocation direction B, the control unit 23 drives the blowing unit 35. Among the blowing units 35 and 36, because the downstream side blowing unit located downstream with respect to the direction of reciprocation of the carriage 16 is capable of blowing air toward the mist immediately after the mist has been generated from the recording head 7, the effect of moving the mist by the downstream side blowing unit is larger than that by the upstream side blowing unit located on the upstream side. Consequently, the recording device 1 of this embodiment, by causing only the downstream side blowing unit to be driven, effectively suppresses a decrease in image quality caused by the mist attaching to the contaminants attached to the target recording medium P and reduces power consumption as a result of not causing the upstream side blowing unit to be driven.

Moreover, in the recording device 1 of this embodiment, not only the contaminant-collecting unit 20 but the mist-collecting unit 19 is also formed upstream of the ejection region in the transport direction A. By forming both the mist-collecting unit 19 and the contaminant-collecting unit 20 upstream of the ejection region in the transport direction A, it is possible to arrange the mist-collecting unit 19 and the contaminant-collecting unit 20 close to each other. Consequently, by having such a structure, it is possible for the mist-collecting unit 19 and the contaminant-collecting unit 20 to have a common part. Here, "it is possible for the mist-collecting unit 19 and the contaminant-collecting unit 20 to have a common part" means that, for example, it is possible for the mist-collecting unit 19 and the contaminant-collecting unit 20 to have a common wall as in the recording device 1 of this embodiment or to have a common fan which is not the case in the recording device 1 of this embodiment.

However, the mist-collecting unit 19 may be formed downstream of the ejection region in the transport direction A. By having such a structure, it is possible to suppress the movement of mist toward the side upstream of the recording head 7 and it is possible to suppress dirtying of the recording medium P by mist before ejection of ink onto the target recording medium P.

Figure 5:
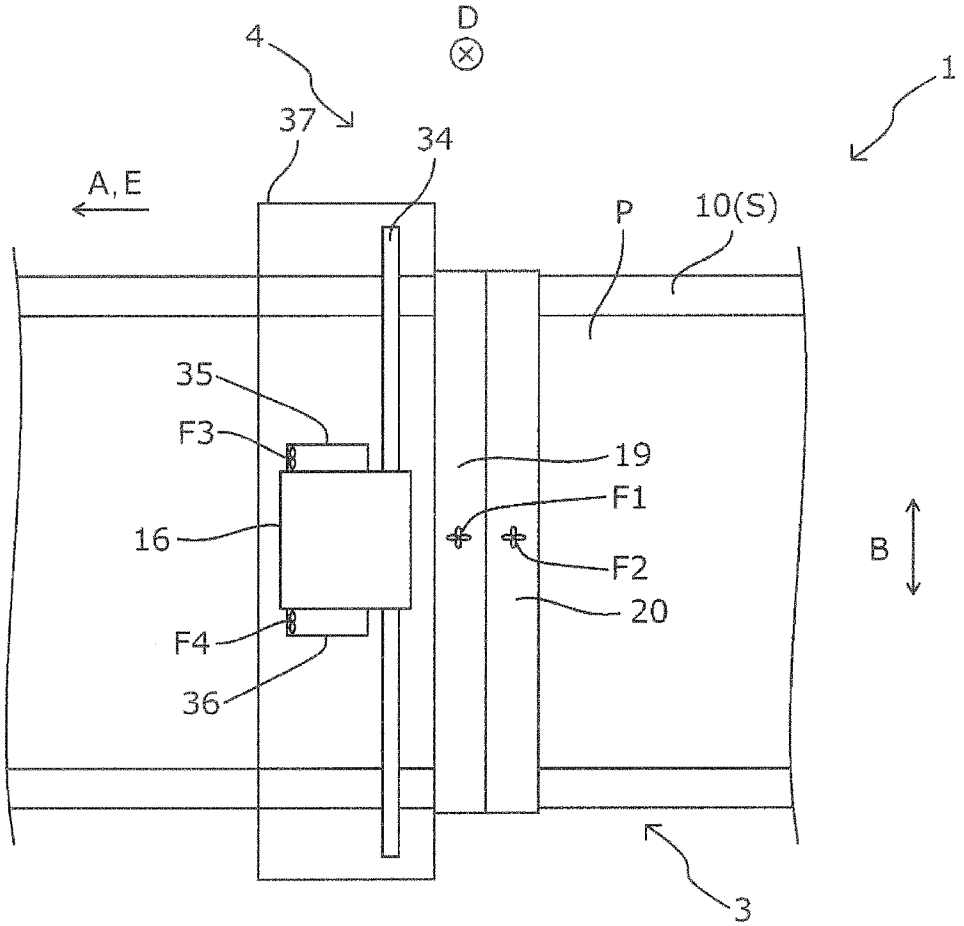
FIG. 5 is a schematic plan view of the main part of the recording device according to a second embodiment of the invention.
Figure 6:
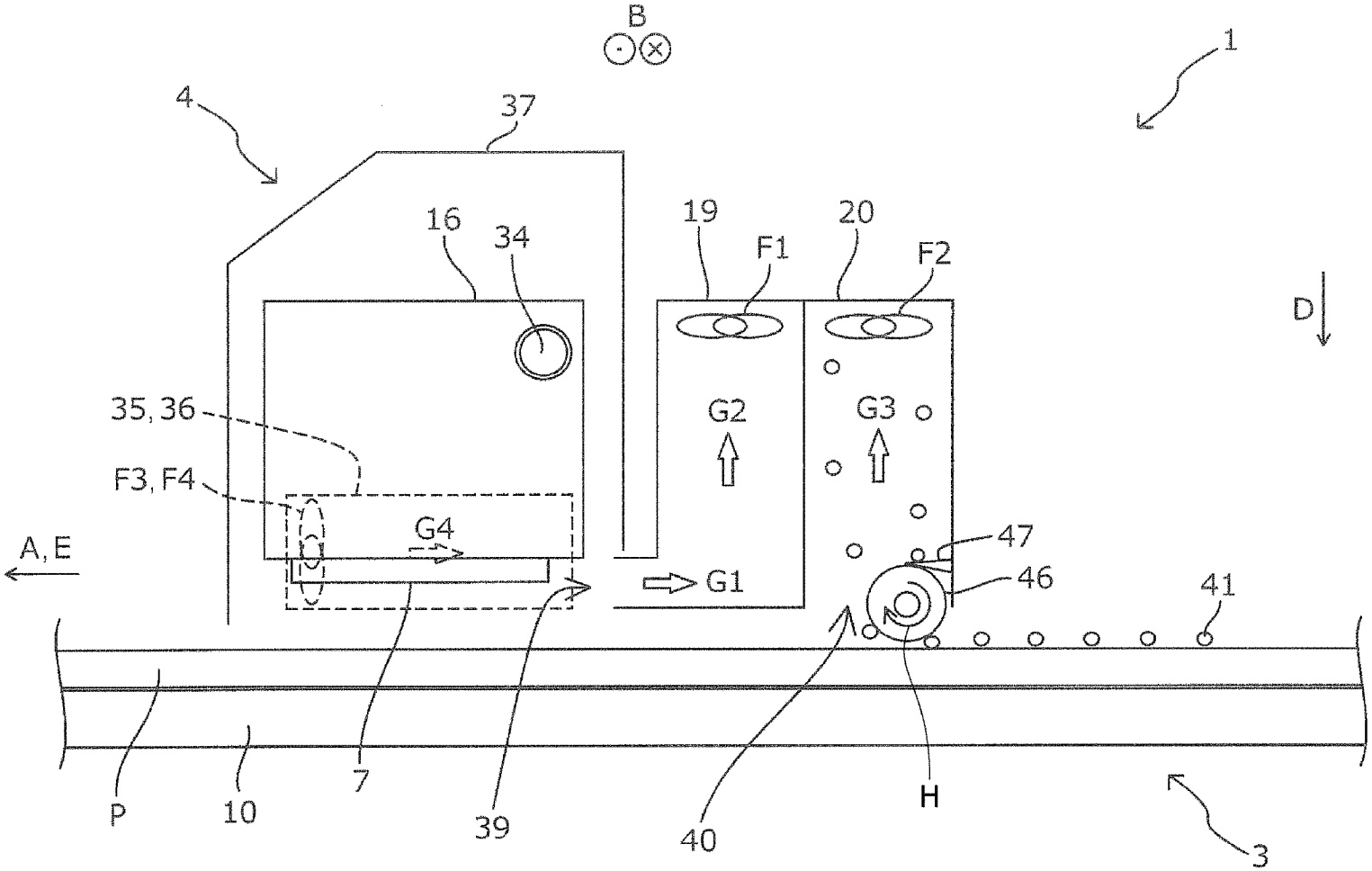
FIG. 6 is a schematic side view of the main part of the recording device according to the second embodiment of the invention.

Second Embodiment, FIGS. 5 and 6

Next, the recording device 1 of the second embodiment will be described with reference to the accompanying drawings.

FIG. 5 is a schematic plan view of the area around the mist-collecting unit 19 and the contaminant-collecting unit 20 of the recording device 1 of the second embodiment and corresponds to FIG. 2 that illustrates the recording device 1 of the first embodiment. Moreover, FIG. 6 is a schematic side view of the area around the mist-collecting unit 19 and the contaminant-collecting unit 20 of the recording device 1 of the second embodiment and corresponds to FIG. 3 that illustrates the recording device 1 of the first embodiment.

Further, the recording device 1 of this embodiment has a similar structure to the recording device 1 of the first embodiment except for the area around the mist-collecting unit 19 and the contaminant-collecting unit 20.

In the recording device 1 of the first embodiment, the mist-collecting unit 19 and the contaminant-collecting unit 20 are formed in the carriage 16.

However, in the recording device 1 of this embodiment, the mist-collecting unit 19 and the contaminant-collecting unit 20 are formed separately from the carriage 16. Moreover, regarding the mist-collecting unit 19 and the contaminant-collecting unit 20, the collection openings 39 and 40 are formed across an entirety in the reciprocation direction B that is the width direction of the sticky belt 10 that intersects the transport direction A. Further, in the recording device 1 of the third to fifth embodiments mentioned later, the structure of each of the collection openings 39 and 40 is similar to the structure of each of the collection openings 39 and 40 of the recording device 1 of this embodiment.

In this way, as long as at least one of the mist-collecting unit 19 and the contaminant-collecting unit 20 has a collection opening formed over an entirety in the width direction of the sticky belt 10 (reciprocation direction B), it is possible to effectively suppress a decrease in image quality due to the mist attaching to the contaminants 41 that have attached to the recording medium P across an entirety in the width direction of the sticky belt 10 (reciprocation direction B).

Moreover, by forming the mist-collecting unit 19 and the contaminant-collecting unit 20 separately from the carriage 16, because it is possible to lighten the carriage 16, it is possible to decrease the movement load of the carriage 16.

Moreover, as illustrated in FIG. 6, the contaminant-collecting unit 20 of this embodiment includes a sticky roller 46 that has an adhesive agent attached to a main surface thereof and that rotates in a rotation direction H with the movement of the sticky belt 10 in the direction E, the sticky belt 10 being in contact with the recording medium P.

That is, in other words, the contaminant-collecting unit 20 of this embodiment includes the sticky roller 46 that serves as a sticky member on which an adhesive agent is attached. Consequently, it is possible to reliably collect the contaminants 41 by using the sticky roller 46.

Further, the contaminant-collecting unit 20 of this embodiment includes a scraper 47 that removes (scrapes off) the contaminants 41 that have attached to the sticky roller 46 with the rotation of the sticky roller 46. It is thus possible for the contaminant-collecting unit 20 of this embodiment to collect the contaminants 41 that have been removed from the sticky roller 46 by the scraper 47 by suction achieved through suction power of the fan F2.

Figure 7:
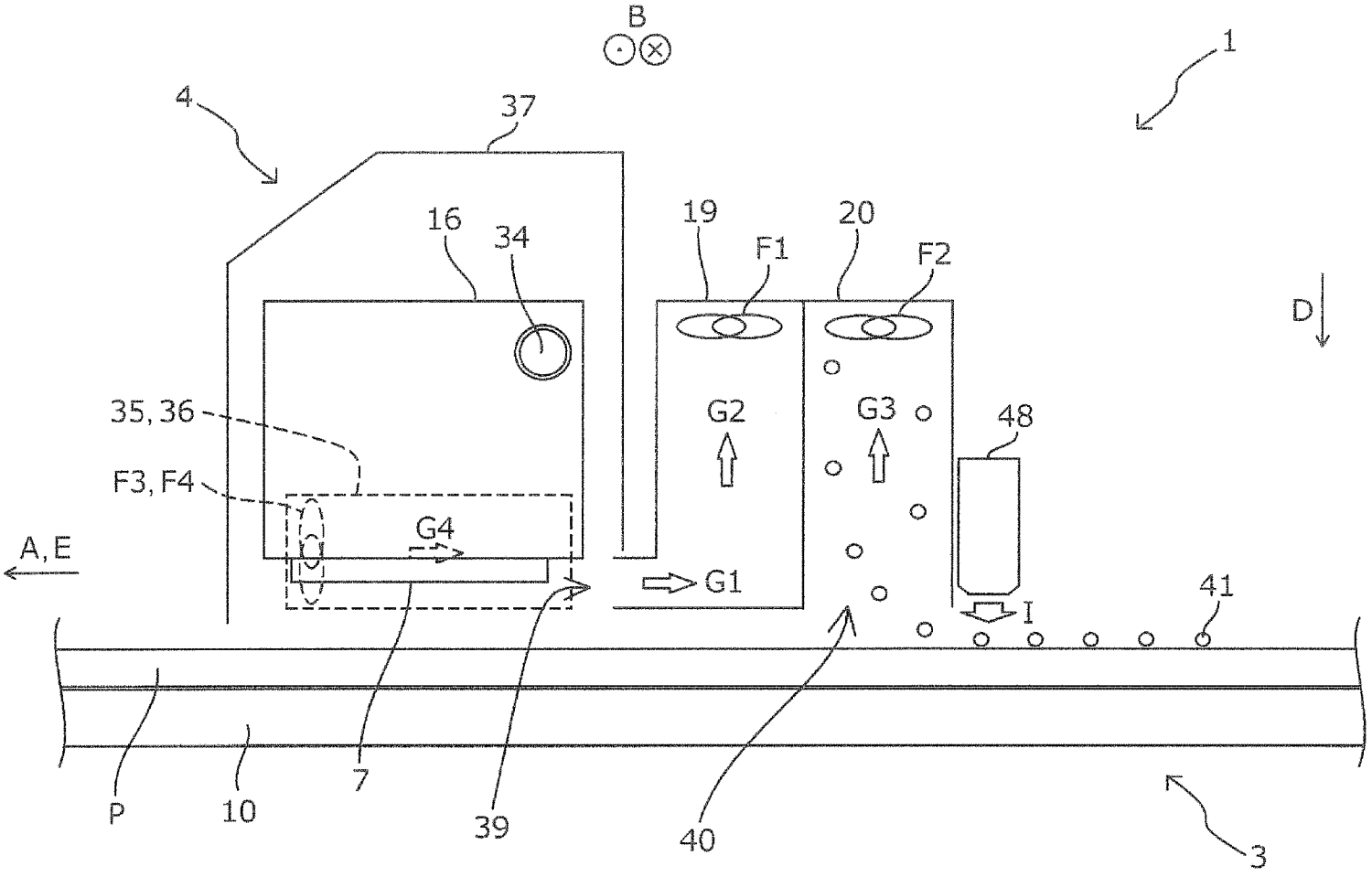
FIG. 7 is a schematic side view of the main part of the recording device according to a third embodiment of the invention.

Third Embodiment, FIG. 7

Next, the recording device 1 of the third embodiment will be described with reference to the accompanying drawings.

FIG. 7 is a schematic side view of the area around the mist-collecting unit 19 and the contaminant-collecting unit 20 of the recording device 1 of the third embodiment and corresponds to FIG. 3 that illustrates the recording device 1 of the first embodiment and FIG. 6 that illustrates the recording device 1 of the second embodiment.

Further, the recording device 1 of this embodiment has a similar structure to the recording device 1 of the first or second embodiments except for the area around the mist-collecting unit 19 and the contaminant-collecting unit 20.

In the recording device 1 of the second embodiment, the sticky roller 46 is formed in the contaminant-collecting unit 20 in order to improve the collecting performance for collecting the contaminants 41.

However, in the recording device 1 of this embodiment, in order to improve the collecting performance for collecting the contaminants 41, instead of forming the sticky roller 46 in the contaminant-collecting unit 20, an ion spraying unit 48 that sprays ionized air in a direction I toward the target recording medium P is included upstream of the collection opening 40 of the contaminant-collecting unit 20 in the transport direction A.

That is, the contaminant-collecting unit 20 of the recording device 1 of this embodiment includes the ion spraying unit 48 that serves as a destaticizing unit that destaticizes the recording medium P by using ions. Consequently, the recording device 1 of this embodiment is capable of suppressing sticking of the recording medium P and the contaminants 41 by destaticization by using the ion spraying unit 48 as a destaticizing unit and is capable of collecting the contaminants 41.

Moreover, in other words, the contaminant-collecting unit 20 of the recording device 1 of this embodiment includes the ion spraying unit 48 that serves as a compressed air unit that blows compressed air onto the recording medium P. Consequently, the recording device 1 of this embodiment is capable of effectively removing the contaminants 41 from the recording medium P by using the ion spraying unit 48 serving as a compressed air unit and is capable of effectively collecting the contaminants 41.

Further, the ion spraying unit 48 of this embodiment serves both as a destaticizing unit and a compressed air unit; however, it may have one of the roles. Moreover, different units serving as a destaticizing unit and a compressed air unit may be individually included.

Figure 8:
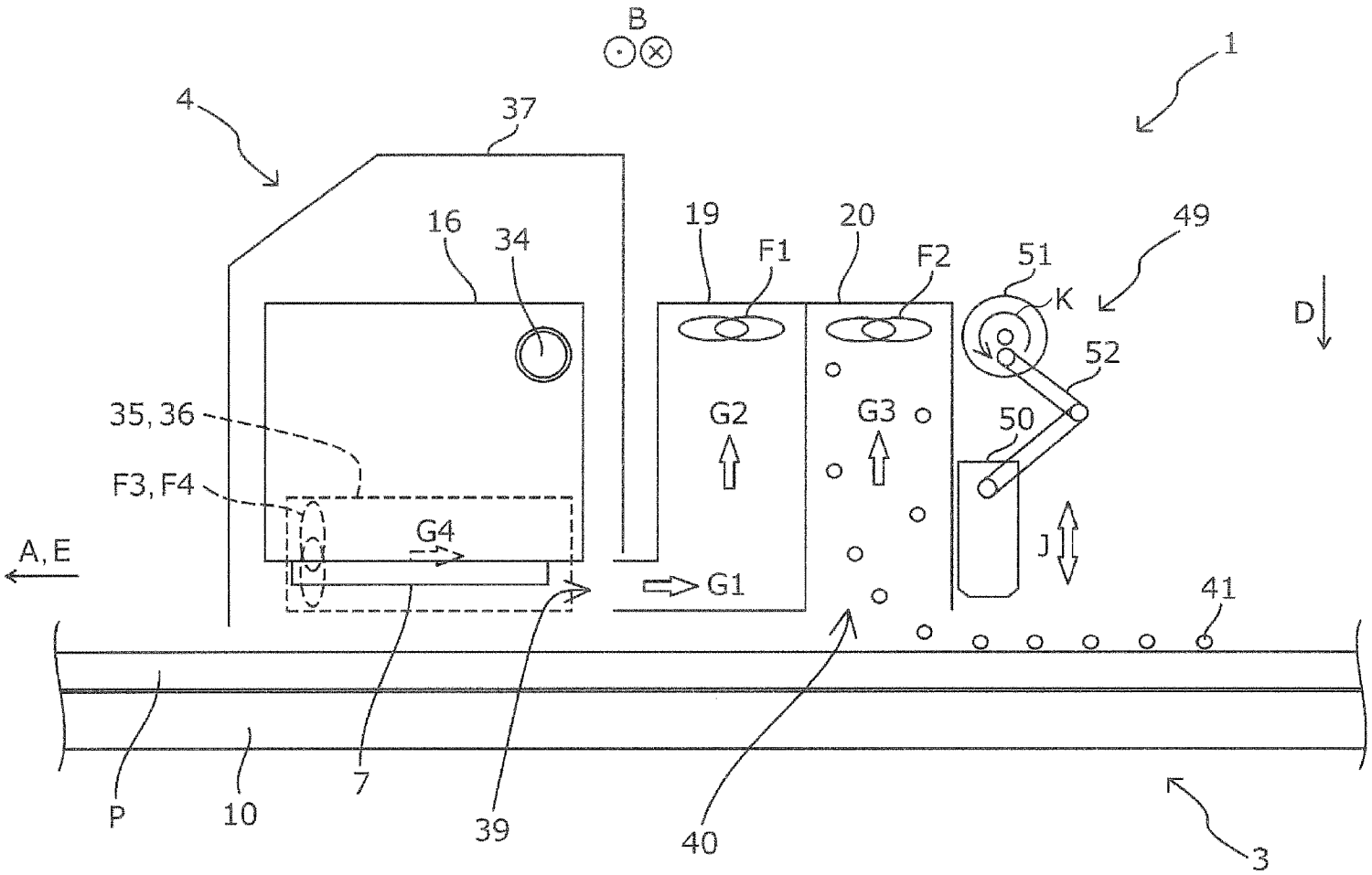
FIG. 8 is a schematic side view of the main part of the recording device according to a fourth embodiment of the invention.

Fourth Embodiment, FIG. 8

Next, the recording device 1 of the fourth embodiment will be described with reference to the accompanying drawings.

FIG. 8 is a schematic side view of the area around the mist-collecting unit 19 and the contaminant-collecting unit 20 of the recording device 1 of the fourth embodiment and corresponds to FIG. 3 that illustrates the recording device 1 of the first embodiment, FIG. 6 that illustrates the recording device 1 of the second embodiment, and FIG. 7 that illustrates the recording device 1 of the third embodiment.

Further, the recording device 1 of this embodiment has a similar structure to the recording device 1 of any of the first to third embodiments except for the area around the mist-collecting unit 19 and the contaminant-collecting unit 20.

In the recording device 1 of the third embodiment, the ion spraying unit 48 is formed in the contaminant-collecting unit 20 in order to improve the collecting performance for collecting the contaminants 41.

However, in the recording device 1 of this embodiment, in order to improve the collecting performance for collecting the contaminants 41, instead of forming the ion spraying unit 48 in the contaminant-collecting unit 20, a vibration generator 49 that causes the recording medium P to vibrate is included upstream of the collection opening 40 of the contaminant-collecting unit 20 in the transport direction A.

As illustrated in FIG. 8, because the recording device 1 of this embodiment includes the contaminant-collecting unit 20 including the vibration generator 49 that causes the recording medium P to vibrate, the recording device 1 of this embodiment is capable of effectively removing the contaminants 41 from the recording medium P by using the vibration generator 49 and is capable of effectively collecting the contaminants 41.

Further, the recording device 1 of this embodiment, similarly to the recording device 1 of the other embodiments, intermittently transports the recording medium P; however, the timing at which the target recording medium P is caused to vibrate is the time at which the target recording medium is moved in the transport direction A (that is, the time at which ink is not ejected from the recording head 7).

Here, in detail, the vibration generator 49 of this embodiment causes the recording medium P to vibrate by reciprocation of a contact unit 50 that comes into contact with the medium in a reciprocation direction J via an arm unit 52 as a result of rotation of a rotation unit 51 in a rotation direction K. However, the vibration generator 49 is not limited to such a structure, and the vibration generator 49 is not particularly limited as long as the vibration generator 49 is a structure that is capable of causing the recording medium P to vibrate.

Figure 9:
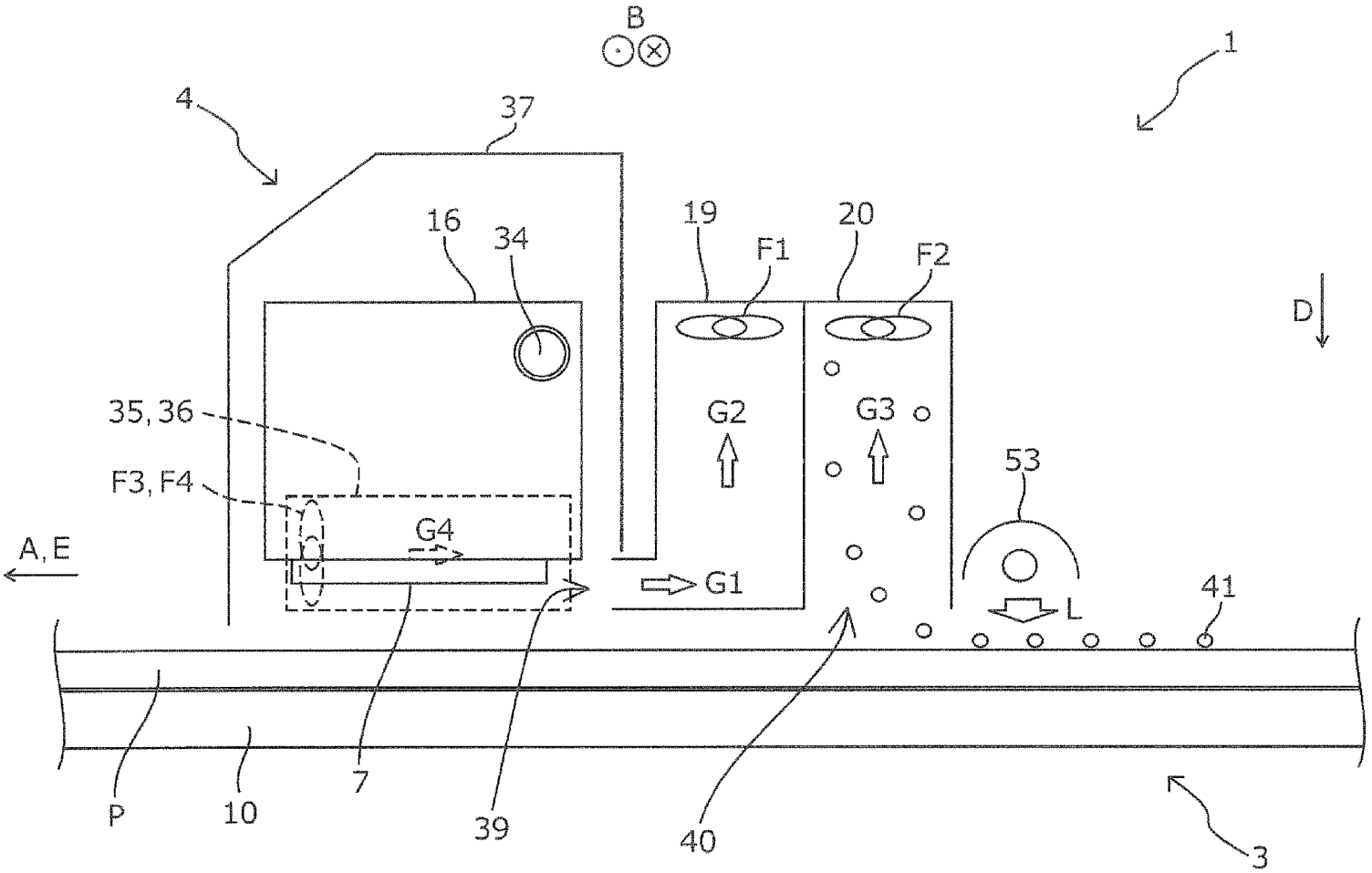
FIG. 9 is a schematic side view of the main part of the recording device according to a fifth embodiment of the invention.

Fifth Embodiment, FIG. 9

Next, the recording device 1 of the fifth embodiment will be described with reference to the accompanying drawings.

FIG. 9 is a schematic side view of the area around the mist-collecting unit 19 and the contaminant-collecting unit 20 of the recording device 1 of the fifth embodiment and corresponds to FIG. 3 that illustrates the recording device 1 of the first embodiment, FIG. 6 that illustrates the recording device 1 of the second embodiment, FIG. 7 that illustrates the recording device 1 of the third embodiment, and FIG. 8 that illustrates the recording device 1 of the fourth embodiment.

Further, the recording device 1 of this embodiment has a similar structure to the recording device 1 of any of the first to fourth embodiments except for the area around the mist-collecting unit 19 and the contaminant-collecting unit 20.

In the recording device 1 of the fourth embodiment, the vibration generator 49 is formed in the contaminant-collecting unit 20 in order to improve the collecting performance for collecting the contaminants 41.

However, in the recording device 1 of this embodiment, in order to improve the collecting performance for collecting the contaminants 41, instead of forming the vibration generator 49 in the contaminant-collecting unit 20, a heating unit 53 that heats the recording medium P by irradiation with electromagnetic waves (infrared rays) in a direction L is included upstream of the collection opening 40 of the contaminant-collecting unit 20 in the transport direction A.

Here, by heating the recording medium P, the adsorption power of the contaminants 41 with respect to the recording medium P may be weakened. Therefore, as illustrated in FIG. 9, because the recording device 1 of this embodiment includes in the contaminant-collecting unit 20 the heating unit 53 that heats the recording medium P, the recording device 1 of this embodiment is capable of effectively removing the contaminants 41 from the recording medium P by using the heating unit 53 and is capable of effectively collecting the contaminants 41.

Further, the heating unit 53 of this embodiment has a structure that is capable of heating the recording medium P by irradiation with electromagnetic waves (infrared rays); however, the structure is not limited to such a structure.

Further, the invention is not limited to the above described embodiments, and it goes without saying that it is possible to make various modifications within the scope of the invention described in the claims and that these are included in the scope of the invention. It should also be appreciated that any two or more of the embodiments shown in FIGS. 6-9 may be combined This application claims priority under 35 U.S.C. § 119 to Japanese Patent Application No. 2016-023392, filed Feb. 10, 2016. The entire disclosure of Japanese Patent Application No. 2016-023392 is hereby incorporated herein by reference.

What is claimed is:

1. A liquid ejecting apparatus comprising:

a transport unit configured to transport a medium, an ejecting unit configured to eject a liquid onto the medium in an ejection area, a mist-collecting unit configured to collect mist that occurs with the ejection of the liquid from the ejecting unit, the mist-collecting unit configured to collect the mist via suction of a first fan along a first exhaust path, and a contaminant-collecting unit that is formed upstream of the ejection area in a transport direction of the medium and that is configured to collect contaminants that have attached to the medium, the contaminant-collecting unit configured to collect the contaminants via suction of a second fan along a second exhaust path.

2. The liquid ejecting apparatus according to claim 1, wherein at least one of the mist-collecting unit and the contaminant-collecting unit has a collection opening that extends over an entirety in a width direction of the transport unit that intersects the transport direction.

3. The liquid ejecting apparatus according to claim 1, wherein the contaminant-collecting unit includes a destaticizing unit configured to destaticize the medium.

4. The liquid ejecting apparatus according to claim 1, further comprising:

a carriage that includes the ejecting unit and that reciprocates in a width direction of the transport unit that intersects the transport direction, wherein at least one of the mist-collecting unit and the contaminant-collecting unit has a collection opening formed in the carriage.

5. The liquid ejecting apparatus according to claim 1, wherein a collection opening of the mist-collecting unit faces in a direction different to a direction of gravity.

6. The liquid ejecting apparatus according to claim 1, further comprising:

a carriage that includes the ejecting unit and that reciprocates in a width direction of the transport unit that intersects the transport direction, wherein a blowing unit configured to blow air toward the collection opening of the mist-collecting unit is formed in the carriage.

7. The liquid ejecting apparatus according to claim 6, wherein said blowing unit is formed at each end of the ejecting unit in the width direction of the transport unit, and, the liquid ejecting apparatus is configured such that among the blowing units at the ends of the ejecting unit, the downstream side blowing unit located downstream with respect to the direction of reciprocation of the carriage blows out air.

8. The liquid ejecting apparatus according to claim 1, wherein the contaminant-collecting unit includes a compressed air unit configured to blow compressed air onto the medium.

9. The liquid ejecting apparatus according to claim 1, wherein the contaminant-collecting unit includes a vibration generator configured to vibrate the medium.

10. The liquid ejecting apparatus according to claim 1, wherein the contaminant-collecting unit includes a heating unit configured to heat the medium.

11. The liquid ejecting apparatus according to claim 1, wherein the mist-collecting unit is formed upstream of the ejection area in the transport direction of the medium.

12. The liquid ejecting apparatus according to claim 1, wherein the mist-collecting unit is formed downstream of the ejection area in the transport direction of the medium.

13. The liquid ejecting apparatus according to claim 1, wherein the mist-collecting unit and the contaminant-collecting unit are disposed adjacent to each other.

14. The liquid ejecting apparatus according to claim 13, wherein the mist-collecting unit and the contaminant-collecting unit have a common wall.

* * * * *